US006582271B1

(12) United States Patent
Wallis

(10) Patent No.: US 6,582,271 B1
(45) Date of Patent: Jun. 24, 2003

(54) CONSTRUCTIONAL TOY AND APPARATUS FOR MAKING THE SAME

(75) Inventor: John Robert Wallis, London (GB)

(73) Assignee: Seven Towns Limited, Greater London (GB)

( * ) Notice: Subject to any disclaimer, the term of this patent is extended or adjusted under 35 U.S.C. 154(b) by 0 days.

(21) Appl. No.: 09/937,909

(22) PCT Filed: Mar. 6, 2000

(86) PCT No.: PCT/GB00/00795

§ 371 (c)(1),
(2), (4) Date: Sep. 27, 2001

(87) PCT Pub. No.: WO00/57978

PCT Pub. Date: Oct. 5, 2000

(30) Foreign Application Priority Data

Mar. 30, 1999 (GB) ..... 9907382
Mar. 31, 1999 (GB) ..... 9907479

(51) Int. Cl.[7] ..... A63H 33/04
(52) U.S. Cl. ..... 446/86; 446/85; 446/108
(58) Field of Search ..... 446/85, 86, 95, 446/107, 108, 124

(56) References Cited

U.S. PATENT DOCUMENTS

| | | | | |
|---|---|---|---|---|
| 3,432,960 | A | * | 3/1969 | Bombaci |
| 3,469,339 | A | | 9/1969 | Thomas |
| 3,830,011 | A | * | 8/1974 | Ochrymowich |
| 4,274,222 | A | | 6/1981 | Zahn et al. |
| 4,579,538 | A | * | 4/1986 | Bass et al. |
| 5,049,105 | A | | 9/1991 | Glickman |
| 5,291,914 | A | | 3/1994 | Bares et al. |
| 6,402,581 | B1 | * | 6/2002 | Podgaiz |

* cited by examiner

*Primary Examiner*—John A. Ricci
(74) *Attorney, Agent, or Firm*—Baker Botts LLP

(57) ABSTRACT

A construction toy comprises a multiplicity of straws, wherein at least some of the straws are joined together with a first straw extending through a second straw via a pair of transversely aligned holes in the second straw. Further, at least some straws are joined together longitudinally by an end of one straw extending tightly into an enlarged socket end of another straw. The invention includes a punch for punching the transverse holes in a straw, a cutter for cutting the straws to a desired length, and an expander for forming the enlarged socket in an end of a straw.

28 Claims, 15 Drawing Sheets

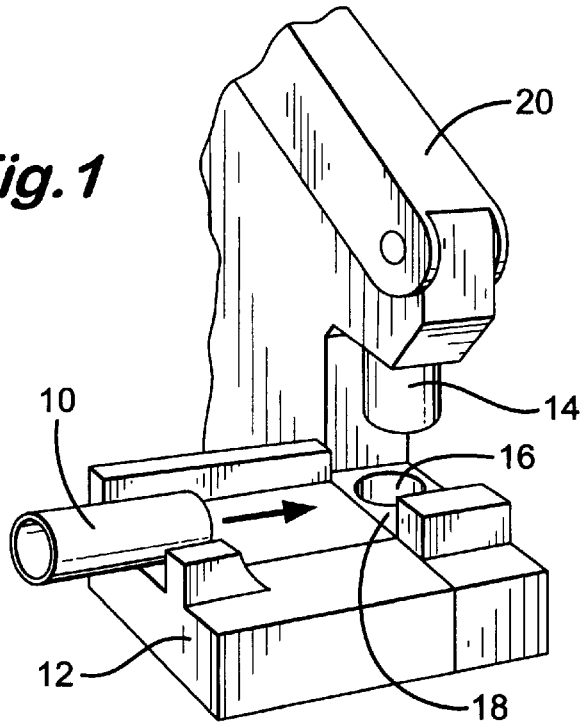
Fig.1
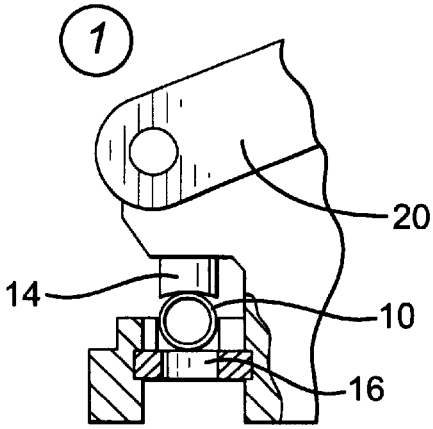
Fig.2a
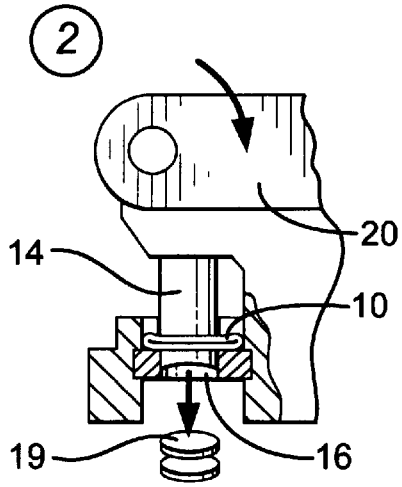
Fig.2b
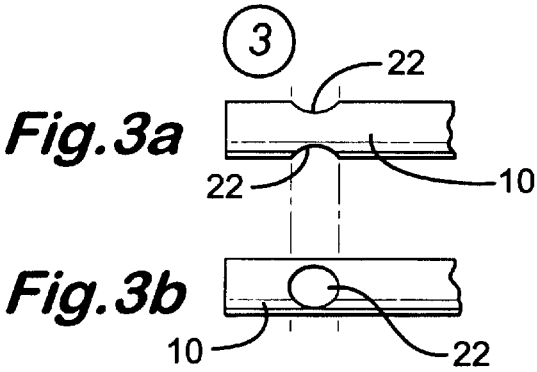
Fig.3a
Fig.3b

CONSTRUCTIONAL TOY AND APPARATUS FOR MAKING THE SAME

The present invention relates to a constructional toy or model comprising a multiplicity of straws joined together, to a method of making the toy or model and to a constructional system or kit for making models out of straws. It further provides a device for punching transverse holes in a straw.

A construction system for making models out of straws has previously been sold under the trade name Construct-O-Straws. It comprised a set of plastics straws and plastics joining parts formed with spigots which fitted endwise into the straws to form junctions between them. The joining parts might have two spigots for forming a linear or comer junction, three spigots for forming a T-junction or four or more spigots for forming more complex junctions. However, the comer parts were noticeable and restricted the appearance of the models made and the range of models that could be made. Furthermore, if a user ran out of joining parts, or of parts of a particular kind, he then had to stop or to purchase an additional kit.

Another construction system is disclosed in U.S. Pat. No. 3,469,339. Tubular members are provided with pre-cut holes each hole having its axis perpendicular to the hole at either side to enable the construction of various models.

A construction element is disclosed in U.S. Pat. No. 4,274,222 and comprises a flexible tube each end of which can receive a rod-like member by pushfit. The flexible tube has a pair of pre-cut oppositely facing holes at its mid-point which can accommodate another flexible tube. Using the several such elements a user is able to construct a variety of joints to construct models from the rod-like members.

One problem with which ,the invention is concerned is to provide a constructional toy, based on assembling straws together, in which the user is not liable to run out of necessary parts for model making.

Another problem with which the invention is concerned is to provide constructional toys or models based on straws in which the whole of a complex model may, if the user so wishes, be formed from the straws.

A further problem with which the invention is concerned is to provide simple and effective apparatus for use in making toys or models as aforesaid.

In one aspect the invention provides a construction kit comprising a multiplicity of straws; characterized by a punch for punching pairs of transversely aligned holes at arbitrary locations through the straws;

the straws and punch permitting a model to be made in which at least some straws are joined together with a first straw extending through a second straw via a pair of transversely aligned holes at an arbitrary location along the second straw, each of said holes being surrounded by portions of the second straw and the first straw fitting tightly within the holes in the second straw.

In a further aspect the invention provides a method for making a model by joining straws together, including the steps of:

providing first and second straws;

punching the a first straw at an arbitrary position along the straw with a punch having substantially the same external diameter as the straw so that the first straw becomes flattened and a pair of transversely aligned holes are formed which are separated by undamaged regions of the straw;

allowing the straw to recover its shape; and passing a second straw through the pair-of holes in the first straw to form a joint in which there is frictional resistance to axial and angular relative movement between the first and second straws.

In a further aspect the invention provides a constructional system for making models out of straws, including a punch for punching pairs of transversely aligned holes through the straws, a cutter for cutting the straws to length and an expander for expanding ends of straws into receiving sockets.

The invention also provides a set of tools for making models out of straws, including a punch for punching pairs of transversely aligned holes through the straws, a cutter for cutting the straws to length and an expander for expanding ends of straws into receiving sockets.

Other preferred aspects of the invention are defined in the accompanying claims to which attention is hereby directed.

BRIEF DESCRIPTION OF THE DRAWINGS

How the invention may be put into effect will now be described with reference to the accompanying drawings in which:

FIG. 1 is a diagrammatic perspective view of a punch unit for forming pairs of transverse holes in a straw;

FIG. 2*a* and FIG. 2*b* are diagrammatic end views of the punch of FIG. 1 showing successive stages in the cutting of transverse holes in a straw;

FIG. 3*a* and FIG. 3*b* are respectively a side and plan view of a straw in which holes have been cut using the punch unit of FIG. 1;

DETAILED DESCRIPTION OF THE INVENTION

Figure 4:
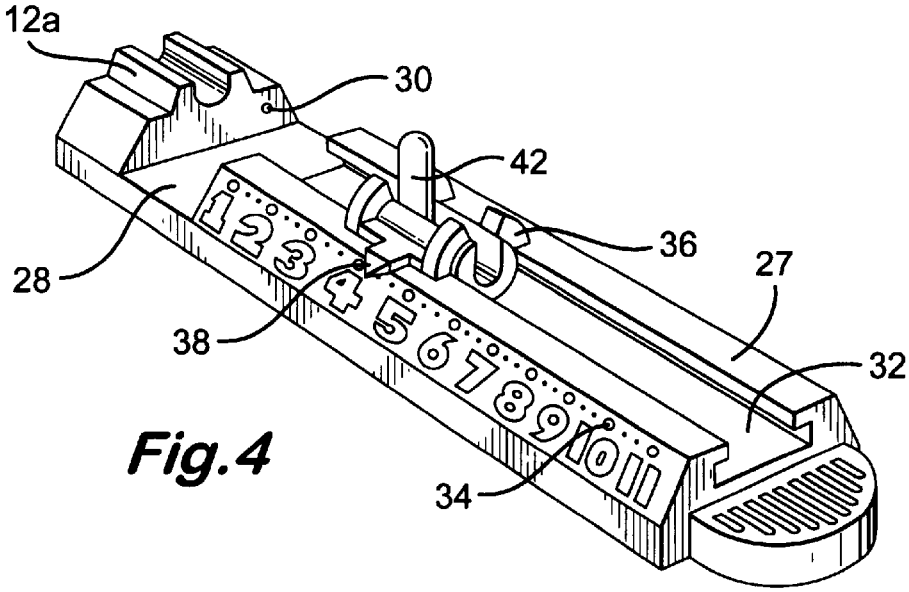
FIG. 4 is a perspective view of a length and angle guide for use with a punch as shown in FIG. 1 and with a movable shuttle for longitudinal and angular positioning of a straw in which holes are to be cut.

The straws which are useful for making the present construction toys are plastics straws, preferably "bendy straws" (i.e. straws which incorporate a corrugated bendable region) and preferably made of polypropylene. Suitable straws of 5 mm external diameter are available from Unique Industries Inc of Philadelphia, USA and from Amscan Inc, also of the USA. For a limited range of models in which strength is less important and end to end tube joins are not needed, paper straws could be used instead.

FIG. 1 shows a polypropylene straw 10 of 5 mm external diameter supported between the walls of entry guide 12, which have a similar spacing to the external diameter of the tube 10, and passing towards a punch 14 and a die 16. A flat support region or throat 18 surrounds the die 16 and is 7.8 mm wide which is sufficient to allow a region of the tube adjacent the die 18 to become flattened during the punching operation. As handle 20 is depressed the punch 14 which is of 5 mm external diameter contacts the straw as shown in FIG. 2*a* and then travels down and crushes the straw flat up to the full width of the throat, after which the punch 14 bursts through the straw 10 and ejects two 5 mm diameter discs 19 into the barrel of the die as shown in FIG. 2*b*. The handle 20 is released and spring-returns, permitting the straw to recover its circular shape. As seen in FIGS. 3*a* and 3*b*, there is formed a pair of transversely opposed holes 22 in the straw 10 which are separated by un-cut regions of the straw and are closed. The holes 22 assume an elliptical shape in side view and provide the necessary frictional grip on a straw passed through them so that there is formed a joint which may be "posed" in the sense that the axial and angular positions of the joined components can be retained. We have found that the size of the hole punched through the straw is important to forming the desired poseable joint with another straw of the same size, and that the best size for the hole cut is equal to the external diameter of the straw. With the present size of straw, the range of tolerance is about ±0.1 mm. If the hole size is too small, then it is difficult to push another straw through, and if it is too large, the friction grip of the resulting joint is too low for model making.

Figure 5:
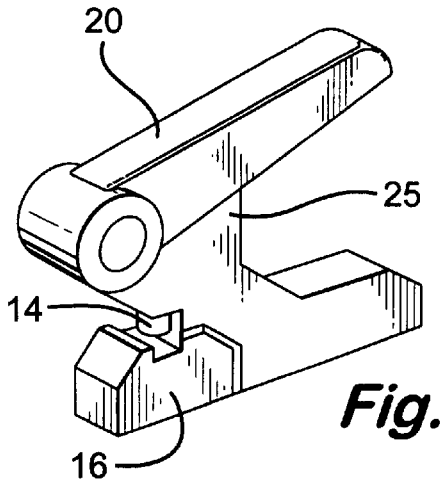
FIG. 5 is a perspective view of a punch tool which can be hand held or used with the length and angle guide of FIG. 4.
Figure 6:
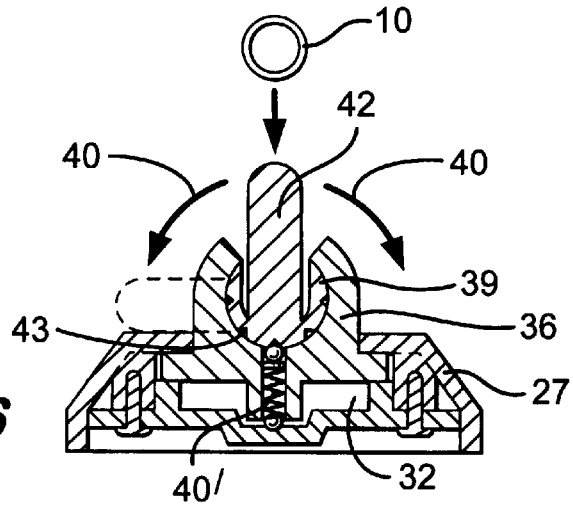
FIG. 6 is a transverse section of the shuttle and of the length and angle guide and FIG. 7 is a view of the punch, part of the length and angle guide and part of the shuttle during punching of the first hole in a straw.

FIGS. 4–6 show in more detail a practical arrangement for the punch. The punch 14, die 16 and operating handle 20 are formed as a separate unit 25 which is a removable fit onto a length and angle guide 27. At one end of the guide 27 there is formed an entry guide region 12*a* which leads to a recess 28 within which the punch unit 25 is removably retainable e.g. by a ball catch 30 which snaps into a recess (not shown) in the unit 25. At the outlet side of the recess 28 an elongate bed 31 is formed a T-shaped slideway 32 along which is formed a distance scale or rule 34. A shuttle 36 fits into and is movable along the slideway 32, its longitudinal position being indicated by a pointer 38. Within the shuttle 36 is a barrel 39 which is supported for bi-directional rotation as indicated by arrows 40 and which carries a post or handle 42. A straw 10 with a first pair of the transverse holes 22 punched in it may be pushed onto the post 42 which fits into the holes. In this way the longitudinal and angular position of the straw may be defined and may be maintained during the punching of one or more further pairs of holes through the straw. The slideway 32 is formed with recesses at regularly spaced intervals along its length and the outer surface of the barrel 39 is also formed with recesses 43 which are engageable by a double duty ball indent 40 for indexing length and angle. In the embodiment shown, angle is in 45 degree steps, but other intervals are possible. After the post has engaged into the holes 22, it may be rotated through two indexed steps, for example, to bring it to the position shown in phantom and to permit a second pair of holes at a different position along the straw to be punched at right angles to the first pair of holes.

Figure 7:
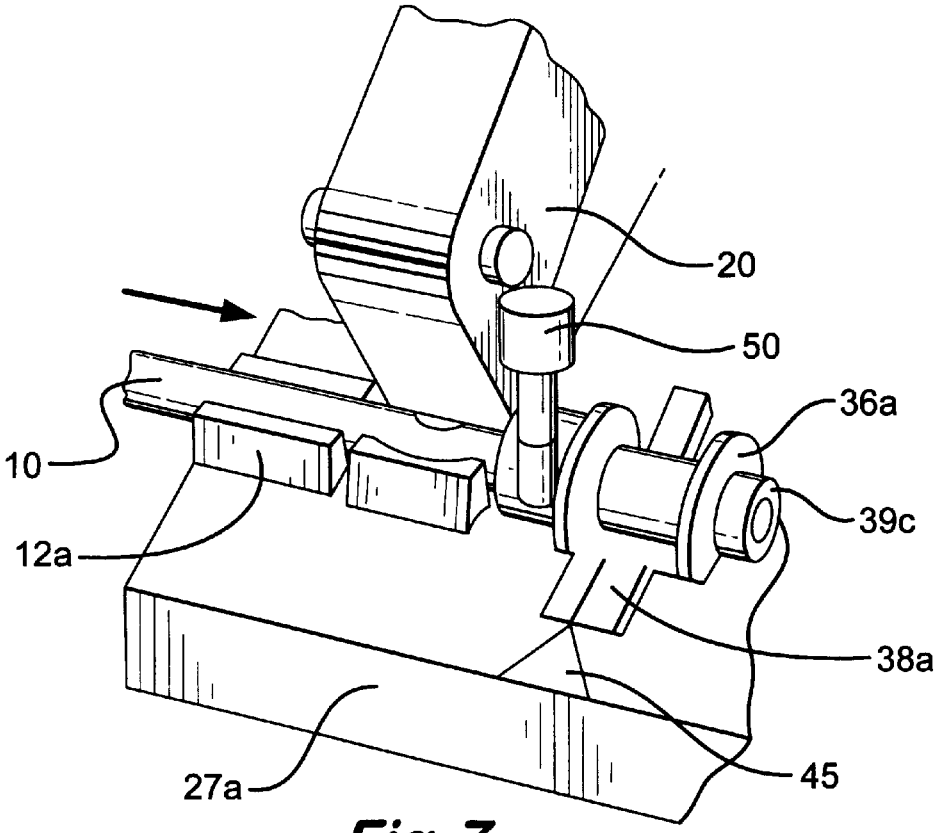
Figure 16:
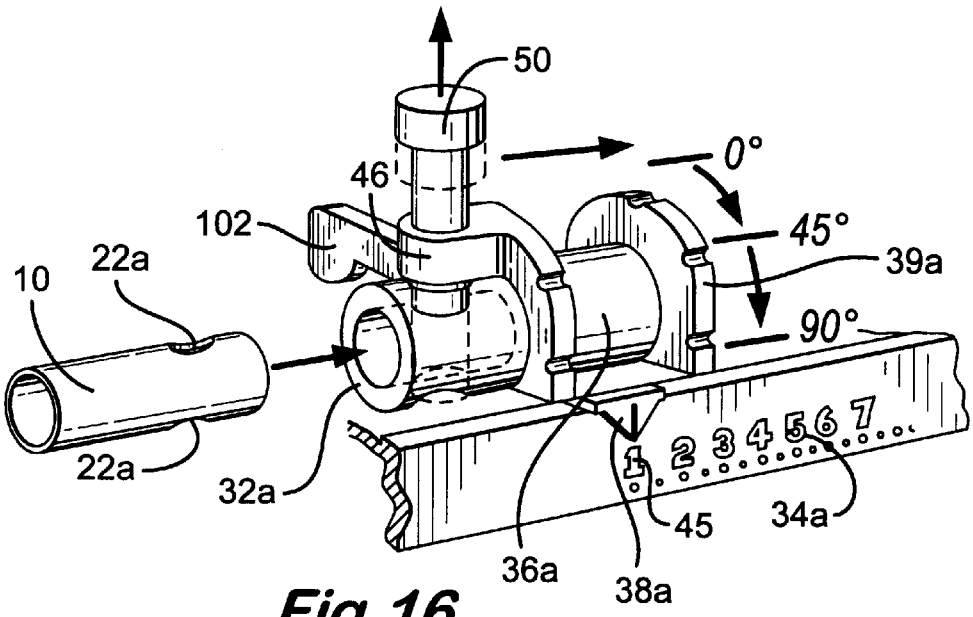

The cutting of the first end hole using a second form of the shuttle assembly is shown in FIG. 7, the form of the shuttle being generally as shown in FIG. 16. The shuttle 36*a* is moved along the slideway 32*a* so as to bring the pointer 38*a* into register with a minimum distance mark 45. The end of the shuttle 36*a* nearer the punch has on its rotatable barrel part 39*a* a rearwardly facing lug 46 which is located at its top in the position shown. A downwardly facing through-hole is formed in the lug 46, into which is insertable a pin 50 whose diameter equals the external diameter of a straw. In order to form a first pair of holes, the straw 10 is engaged into the entry guide 12*a* and advanced until it contacts the pin 50. The handle 20 is then depressed to punch the first hole pair. The pin 50 is then removed, the first pair of holes 22*a* is brought into register with the hole in the flange 46, and the pin is returned and engaged into the holes 22*a*. The pin 50 then provides location for the straw 10, so that the distance to the next desired hole can be measured by sliding the shuttle along the distance scale or length guide 34*a* and reading off the required distance. Holes at the same angular positions or at other angular positions (e.g. 45 or 90 degrees apart) can be created by rotation of the barrel 39*a*. In order to facilitate obtaining of accurate results by a child user, the ball indent provides longitudinal and angular indexing as previously discussed.

Figure 8:
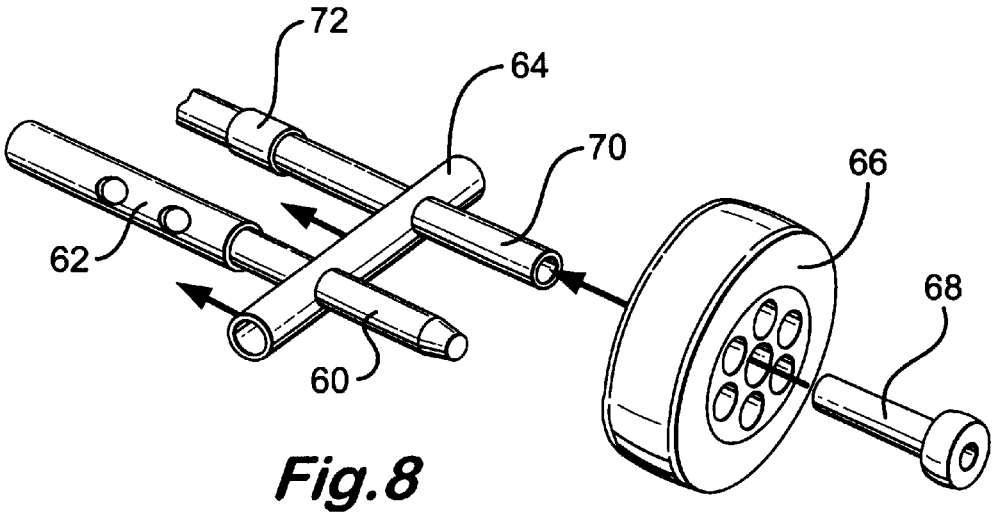
FIG. 8 is a view of punched straws and other toy or model components being assembled together.

Methods of assembling straws together are shown in FIG. 8. A rod-like solid plastics assembly tool 60 is slid into a pre-punched straw 62, after which a second pre-punched straw 64 may be pushed onto the first straw 62 to establish the joint, and the assembly tool 60 can be withdrawn. The assembly tool 60 provided the necessary rigidity to the straw 62 during assembly, speeds up assembly of the joint and makes assembly easier for people of limited dexterity. Also shownin FIG. 8 is an accessory, in this case a wheel 66 which is free to rotate on a pin 68 which is a push fit into an open end of a straw 70. The pin 68 can be used for mounting other accessories e.g. aeroplane propellers.

Figure 9:
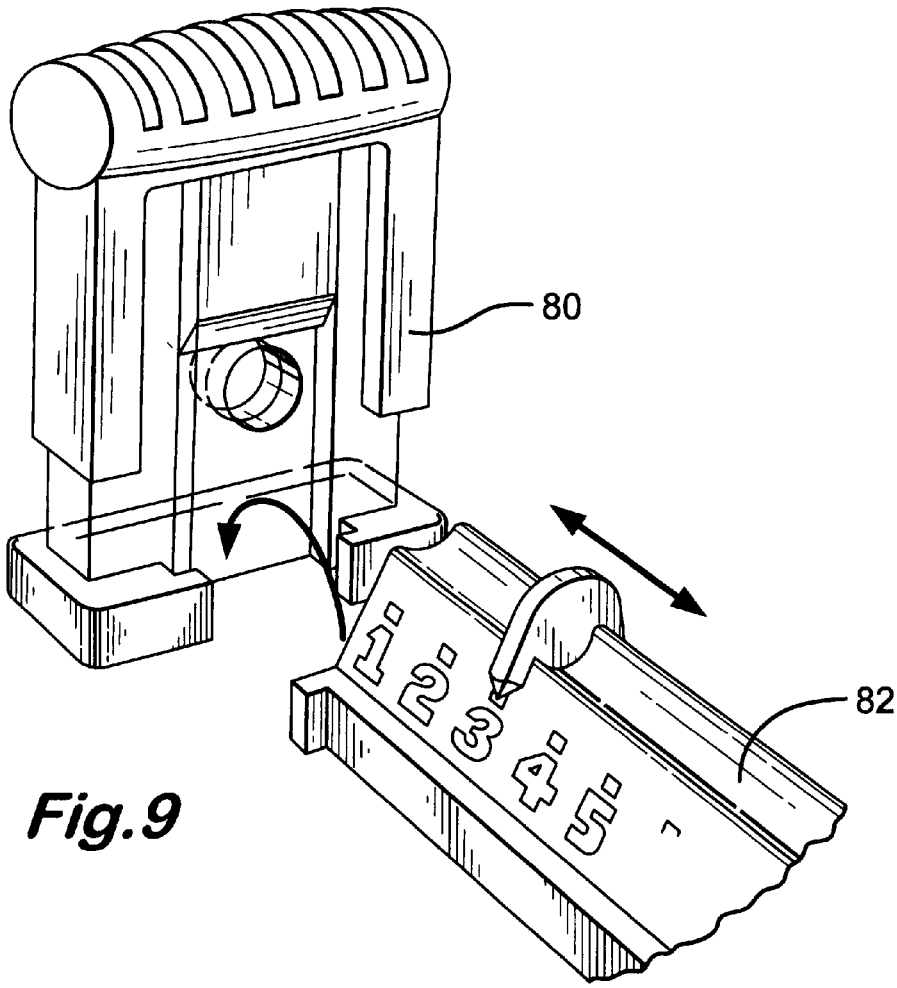
FIG. 9 is a perspective view of a cutting tool and part of an associated length guide.
Figure 10:
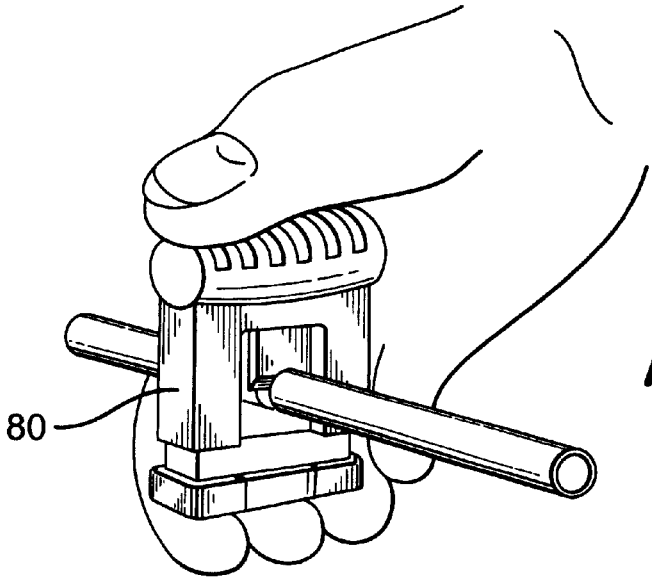
FIG. 10 is a view of the cutting tool separated from the length guide and in use for hand cutting of straws.
Figure 11:
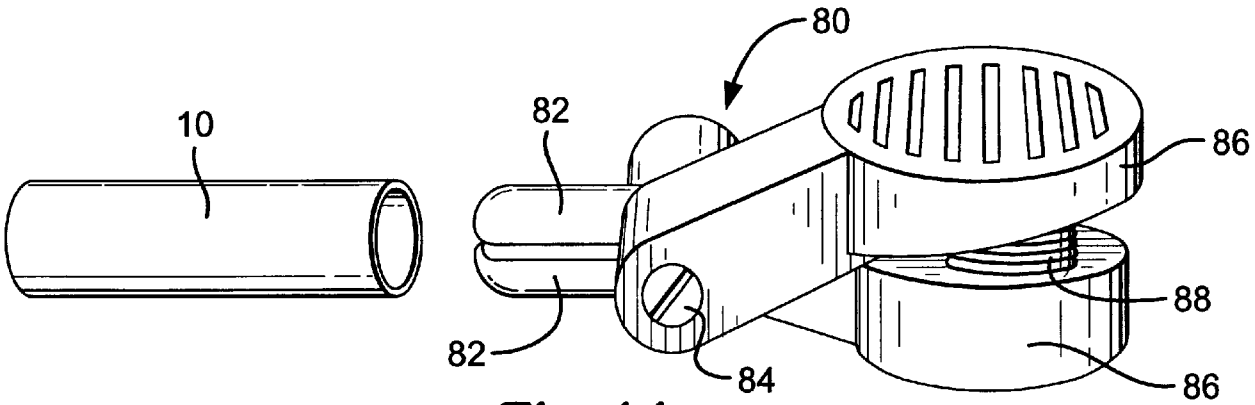
FIG. 11 is a side perspective view of a straw end stretching tool about to be inserted into an end of a straw.

A requirement in model-making is to cut the straws to length. For this purpose a guillotine-type cutter may be provided 80 (FIGS. 9 and 10) may be provided and may be used alone or in position with a length measuring device 82 which fits onto the cutter when required.

Figure 13:
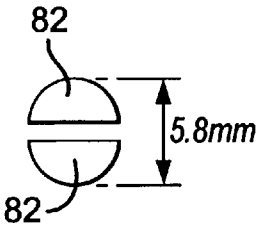
FIG. 12 is a front perspective view of the stretching tool partly inserted into an end of the straw and FIG. 13 is a front view of jaws of the stretching tool after they have been forced apart to stretch the straw.
Figure 12:
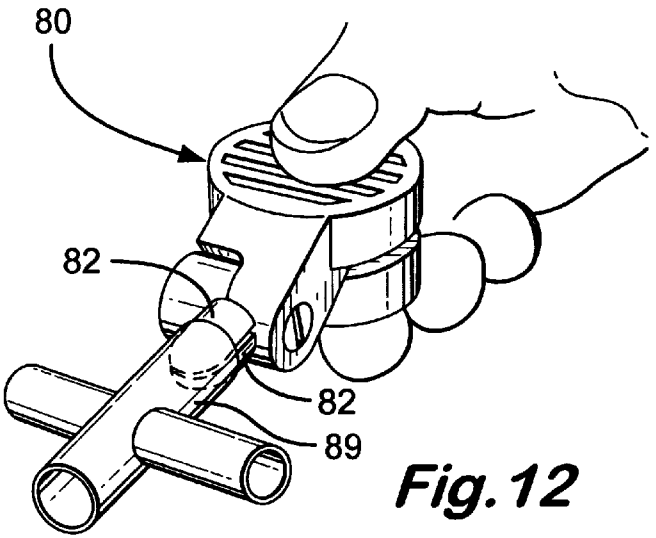
Figure 14:
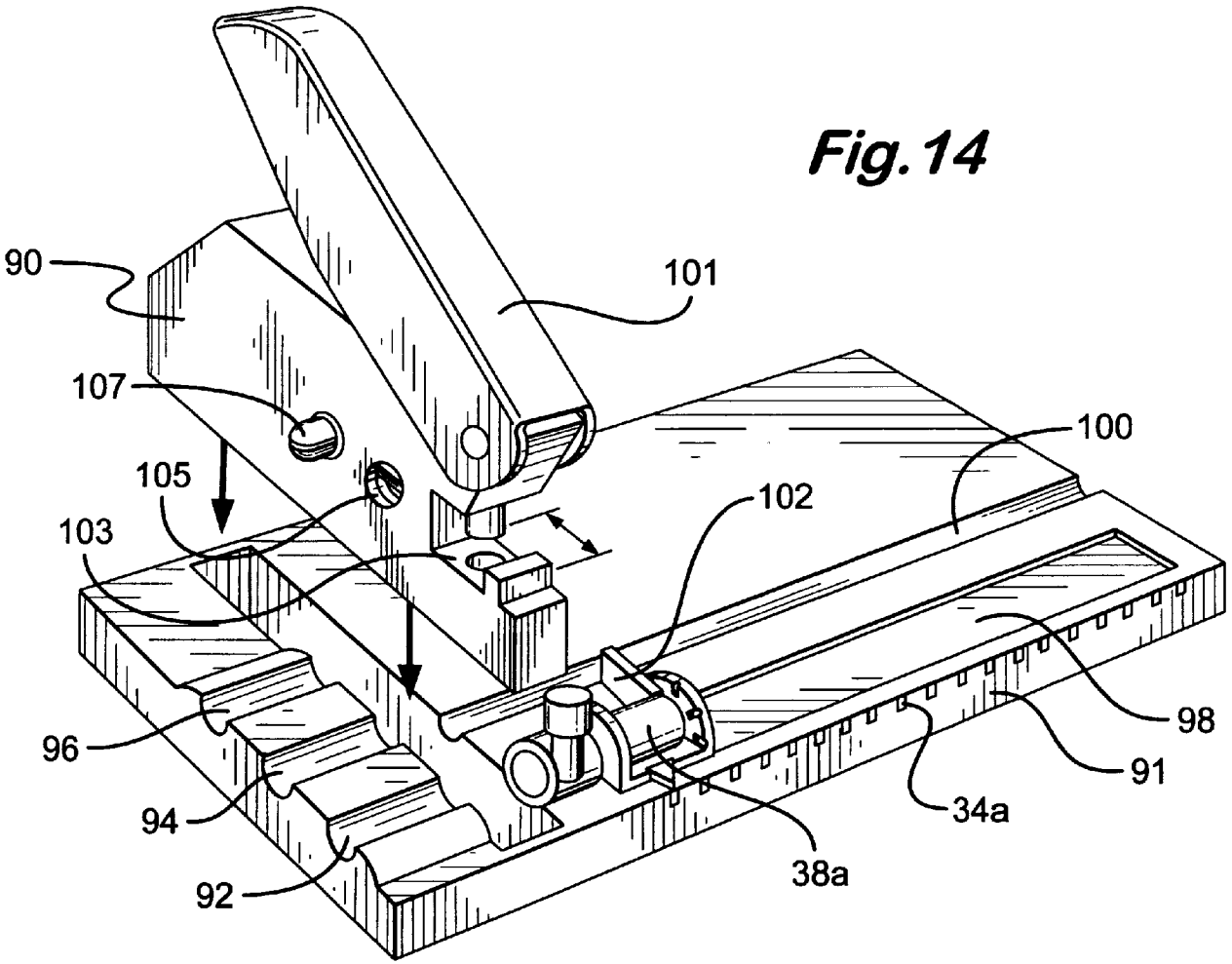
FIG. 14 is a front perspective view of a multi-function straw cutting, punching and expanding machine.
Figure 15:
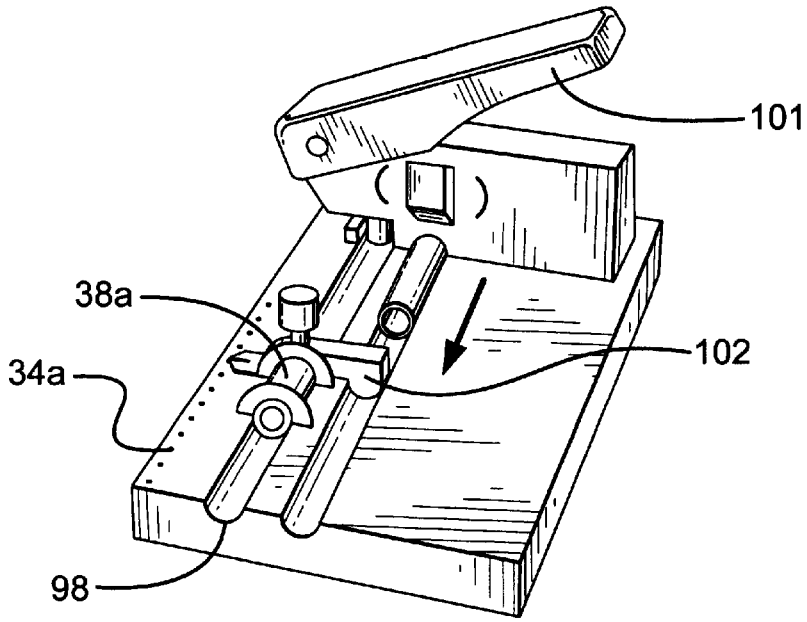
FIG. 15 is a rear view of the machine and FIG. 16 is a detail view in the vicinity of the shuttle of the machine.

The range of models which can be made is expanded if a facility is provided for joining the straws end-to-end, and this is advantageously by socketed joints e.g. the joint 72 of FIG. 8. To form a socket, an expander device 80' is provided which has a pair of jaws 82 of semi-circular profile pivoted together at 84 and controlled by handles 86 biased apart by a spring 88. The jaws 82 are inserted into the open end of a straw 89, after which the handles 86 are moved together by gentle and gradual finger pressure to move the jaws to the position of FIG. 13 where their largest dimension when viewed in front profile is 5.8 mm. Polypropylene exhibits a thixotropic-type behaviour in the sense that an abrupt movement apart of the jaws is likely to burst the socket as it is formed, whereas a more gradual movement will permnit the polypropylene to deform and assume a new shape.

For some modelling kits it may be desirable to provide a tool 90 which combines the functions of a punch, cutter and stretching device. For this purpose, a base 91 is provided which has three parallel inlet guides. A first inlet guide 92 leads to the hole punch, a second inlet guide 94 leads to the cutter and a third inlet guide 96 leads to an expander device. The three guides 92, 94 and 96 are of concave semi-circular shape and are directed parallel to one another. In alignment with the guide 92 there is formed a slideway 98 for a shuttle 38*a* and associated distance scale 34*a*. A support channel 100 extends along the base parallel to the slideway 98 for supporting cut portions of straw. The length measuring facility of the shuttle 38*a* is common to the punching and cutting operations and for this purpose the shuttle 38*a* has a lateral extension or 'wing' which extends across the channel 100 and provides an abutment for positioning a straw in the channels 94, 100 prior to cutting. In association with the base unit there is provided a combined punch, cutter and expander unit which demountably clips onto the base and has a common actuating handle for a punch 103, guillotine cutter 105 and expander 107 whose functions have already been described.

Figure 17:
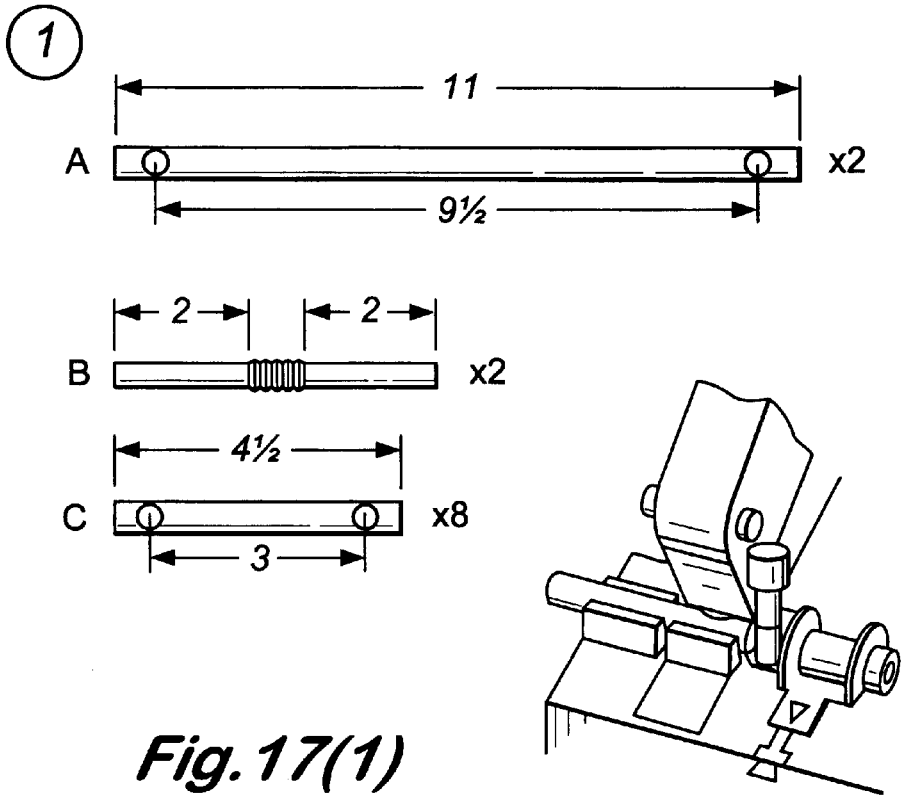
FIGS. 17(1)–17(6) are instructions for making a model swing from "bendy-straws" which can be made simply by punching the straws, cutting them to length and fastening them together using an assembly tool.
Figure 17:
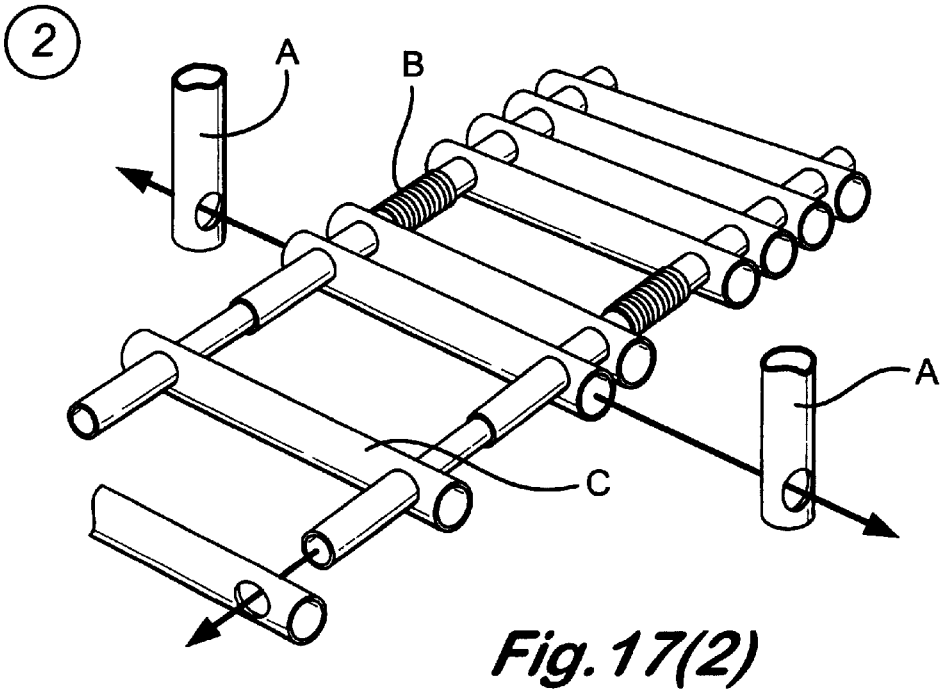
Figure 17:
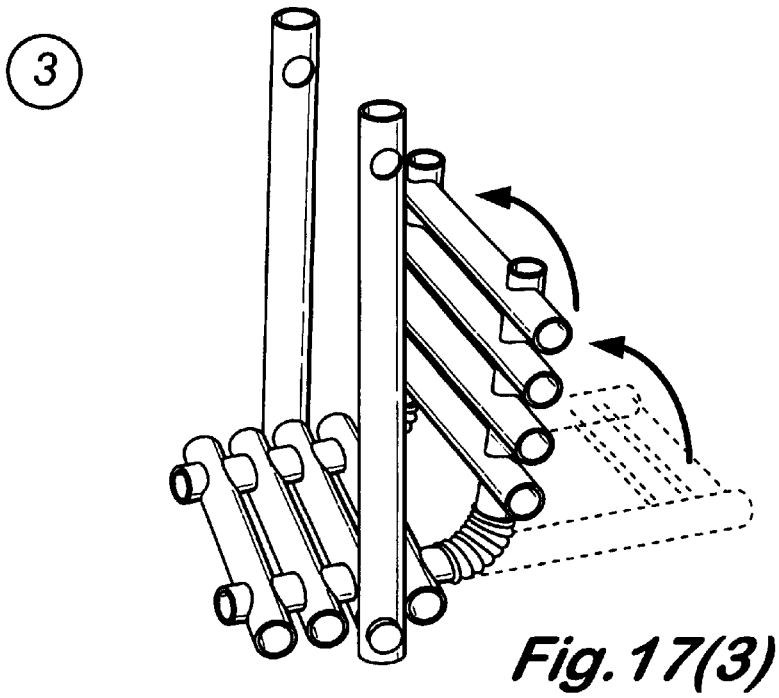
Figure 17:
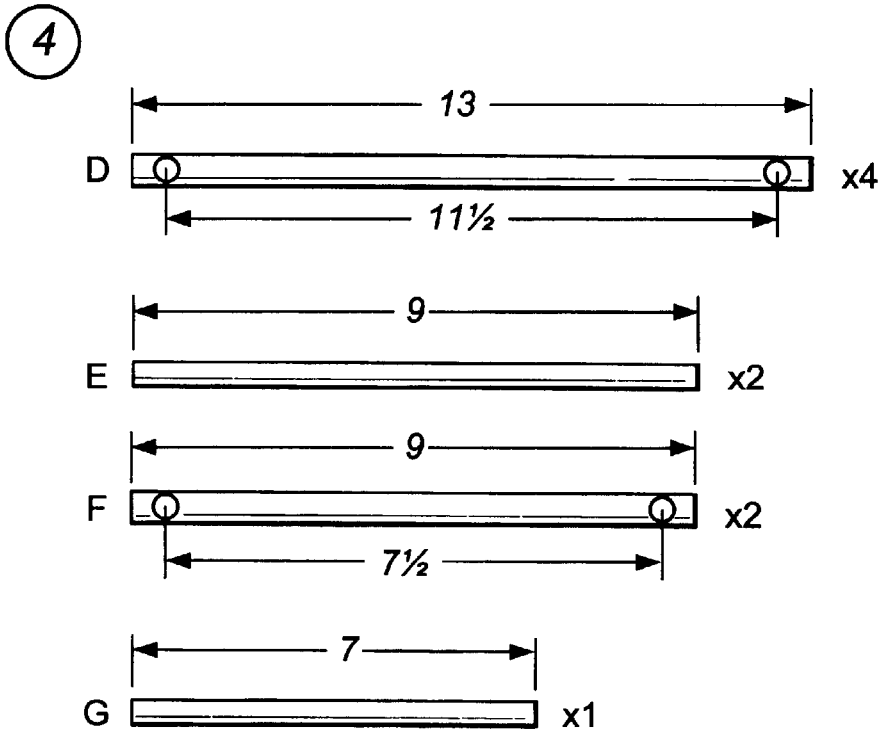
Figure 17:
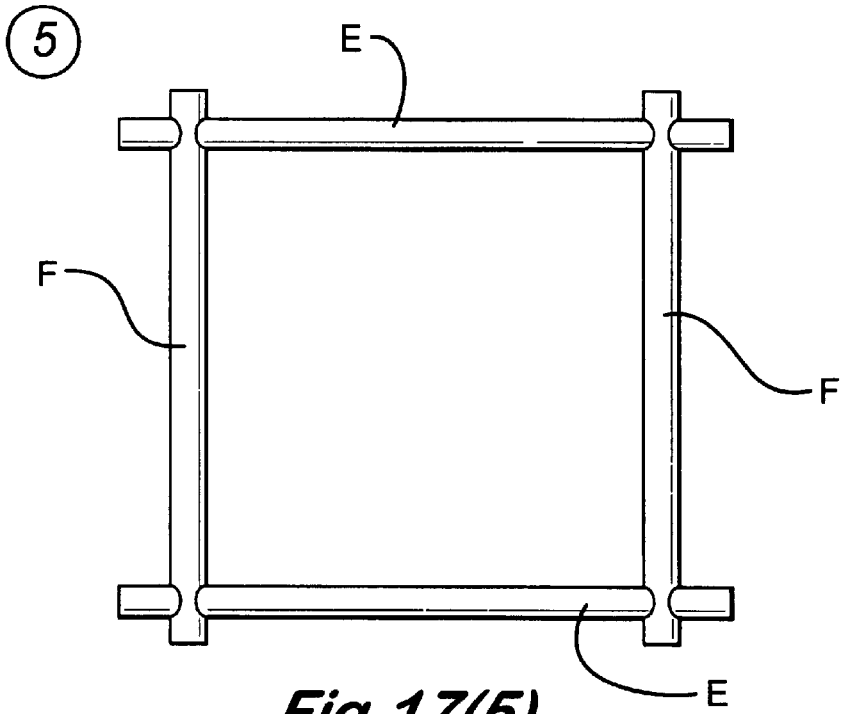
Figure 17:
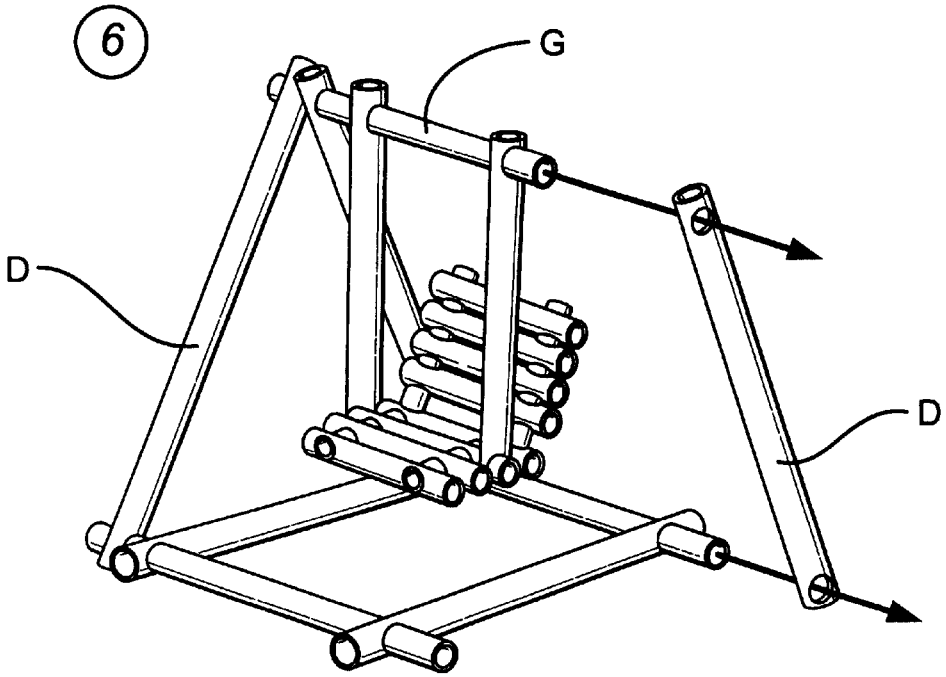
Figure 18:
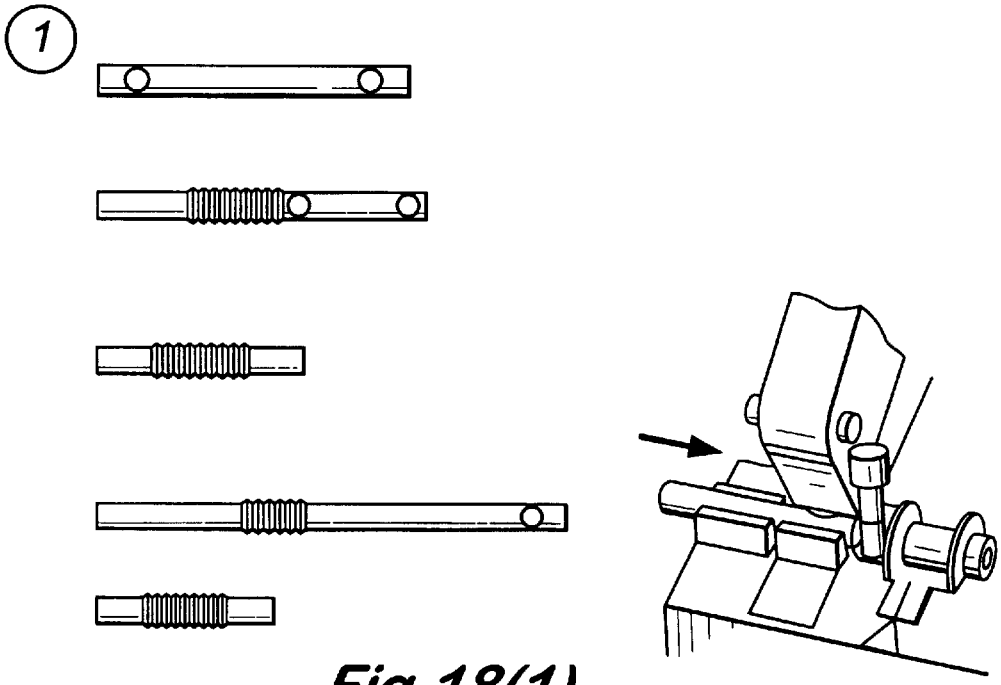
FIGS. 18(1)–18(10) are instructions for making a model car from "bendy straws" involving the expansion of the ends of some of the components and the joining of them end-to-end.
Figure 18:
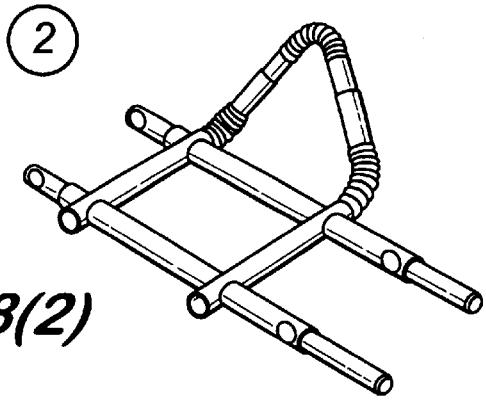
Figure 18:
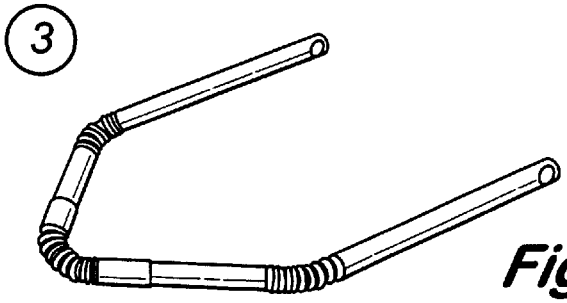
Figure 18:
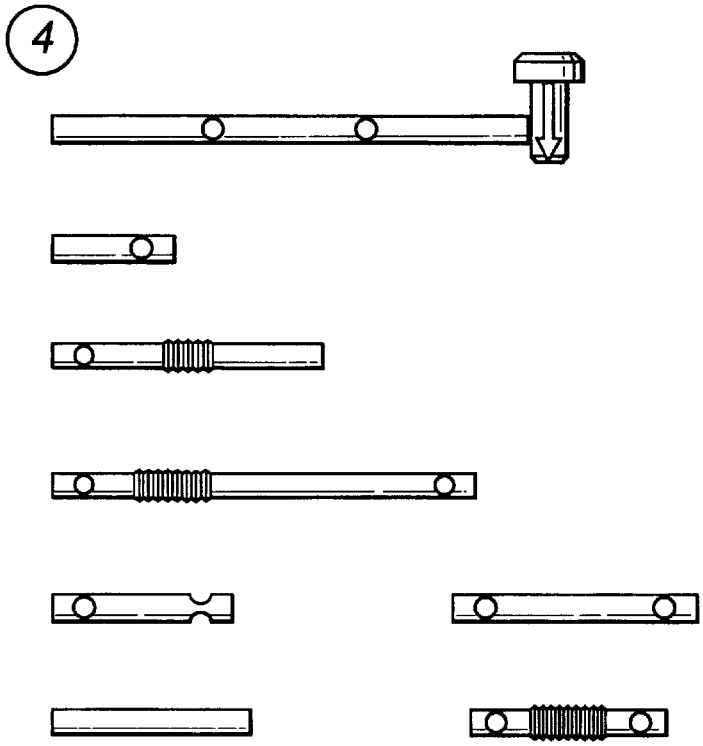
Figure 18:
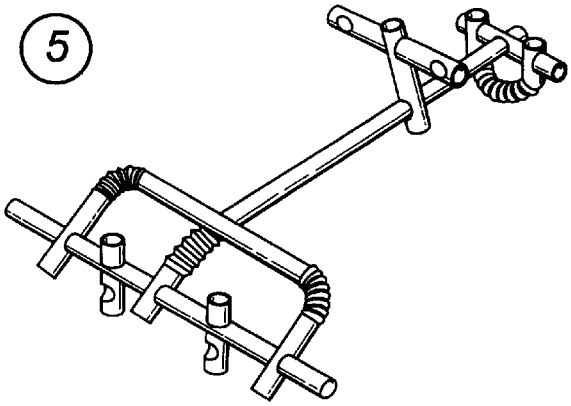
Figure 18:
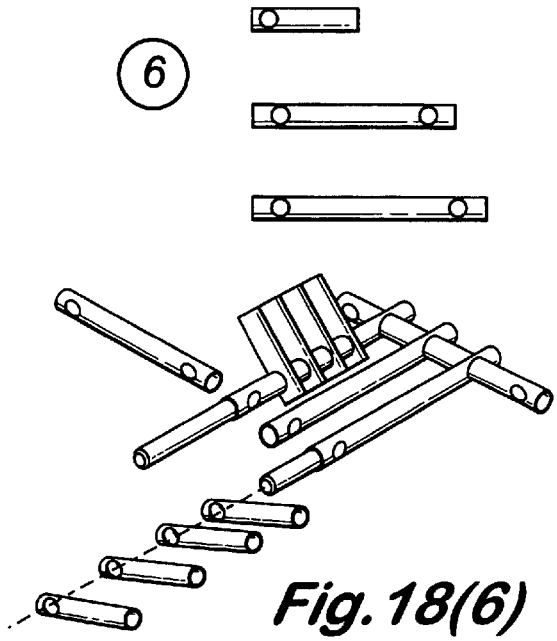
Figure 18:
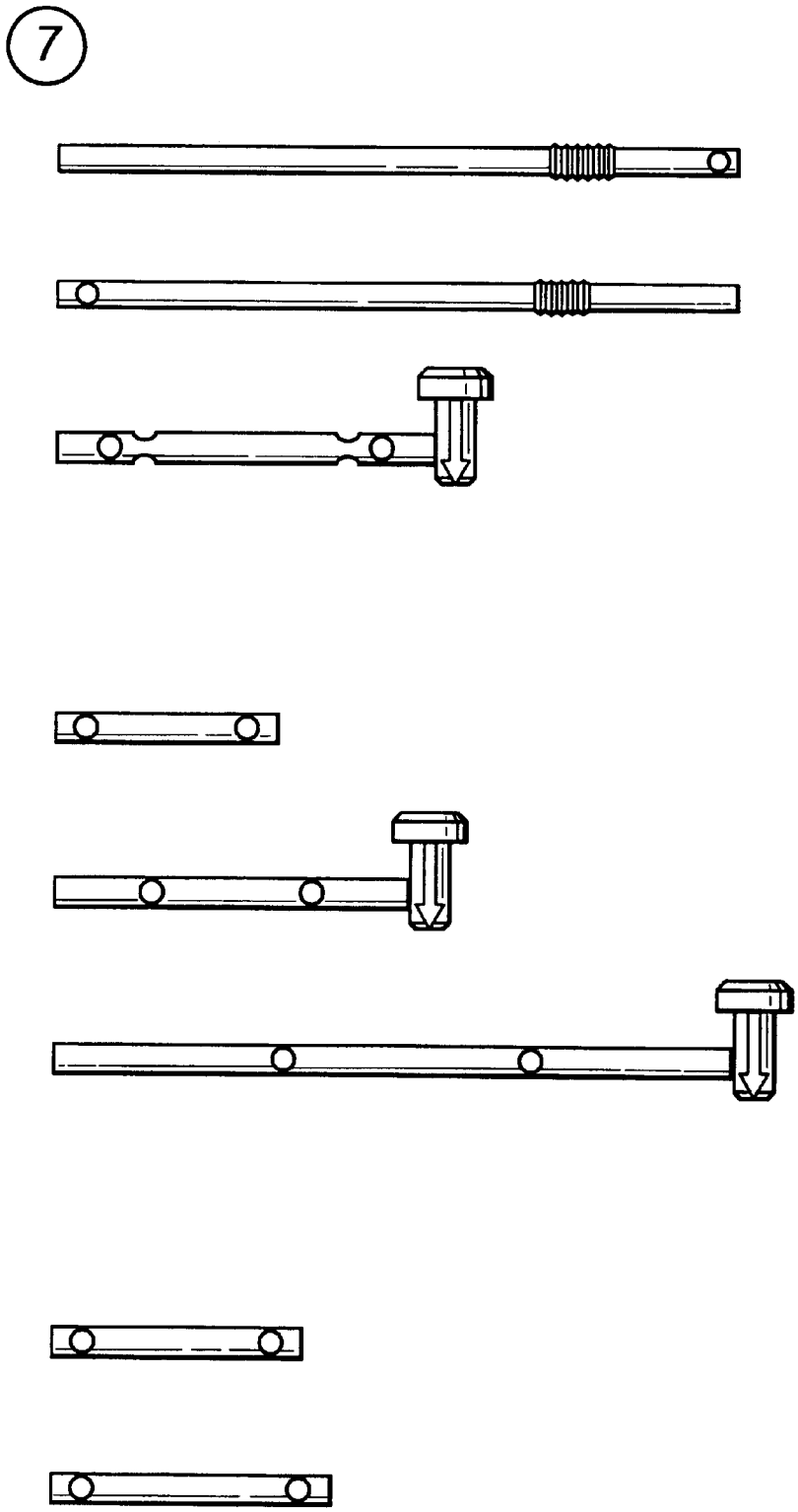
Figure 18:
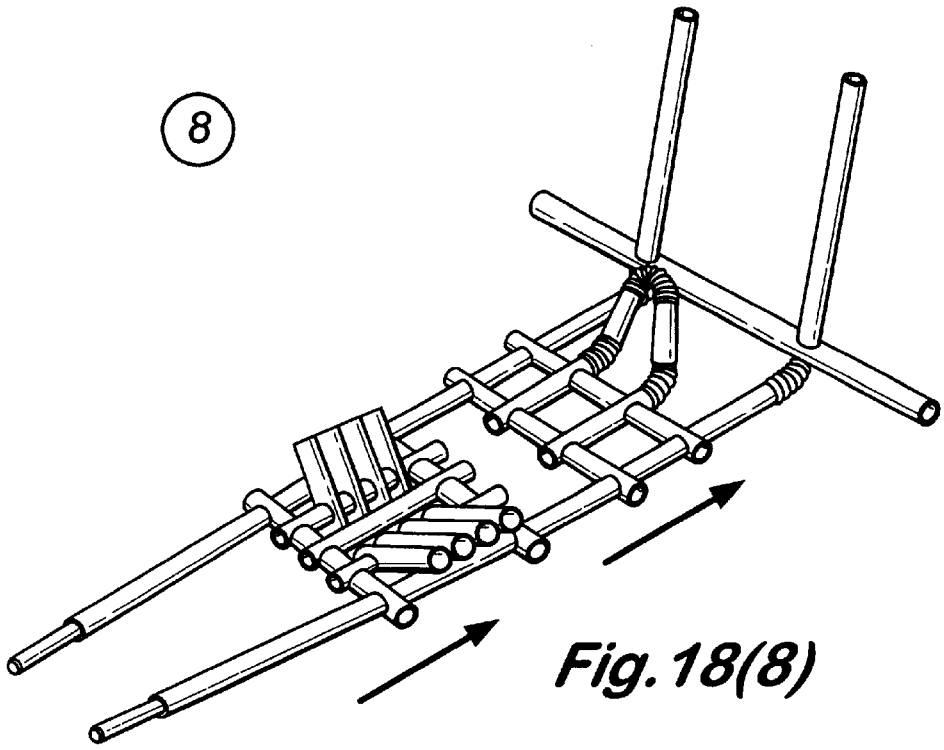
Figure 18:
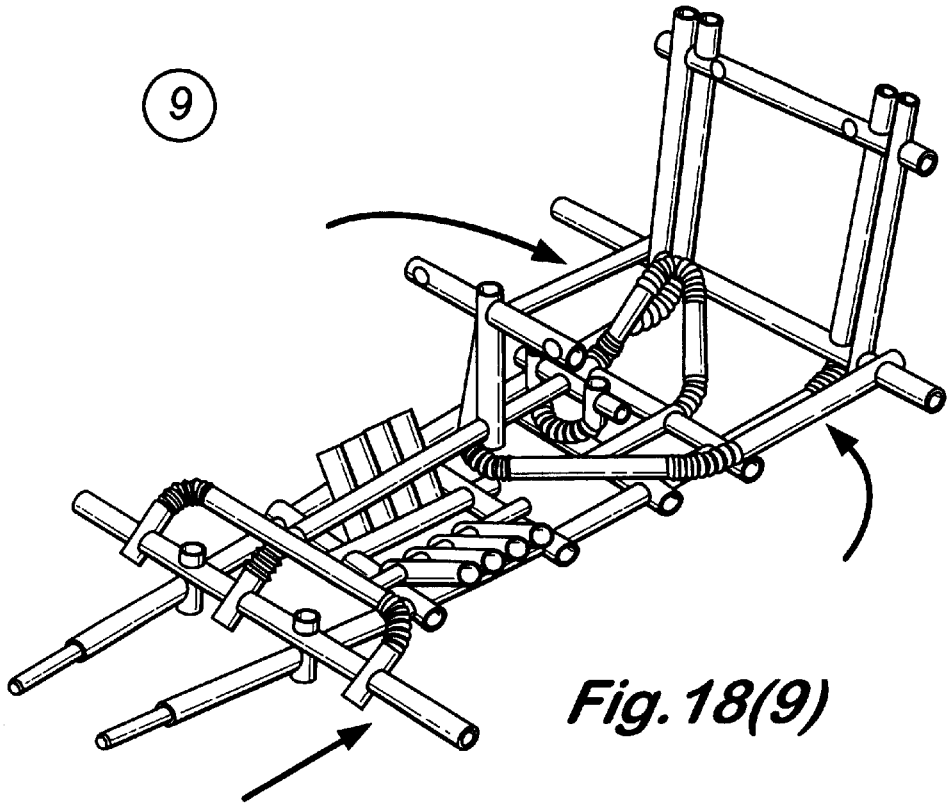
Figure 18:
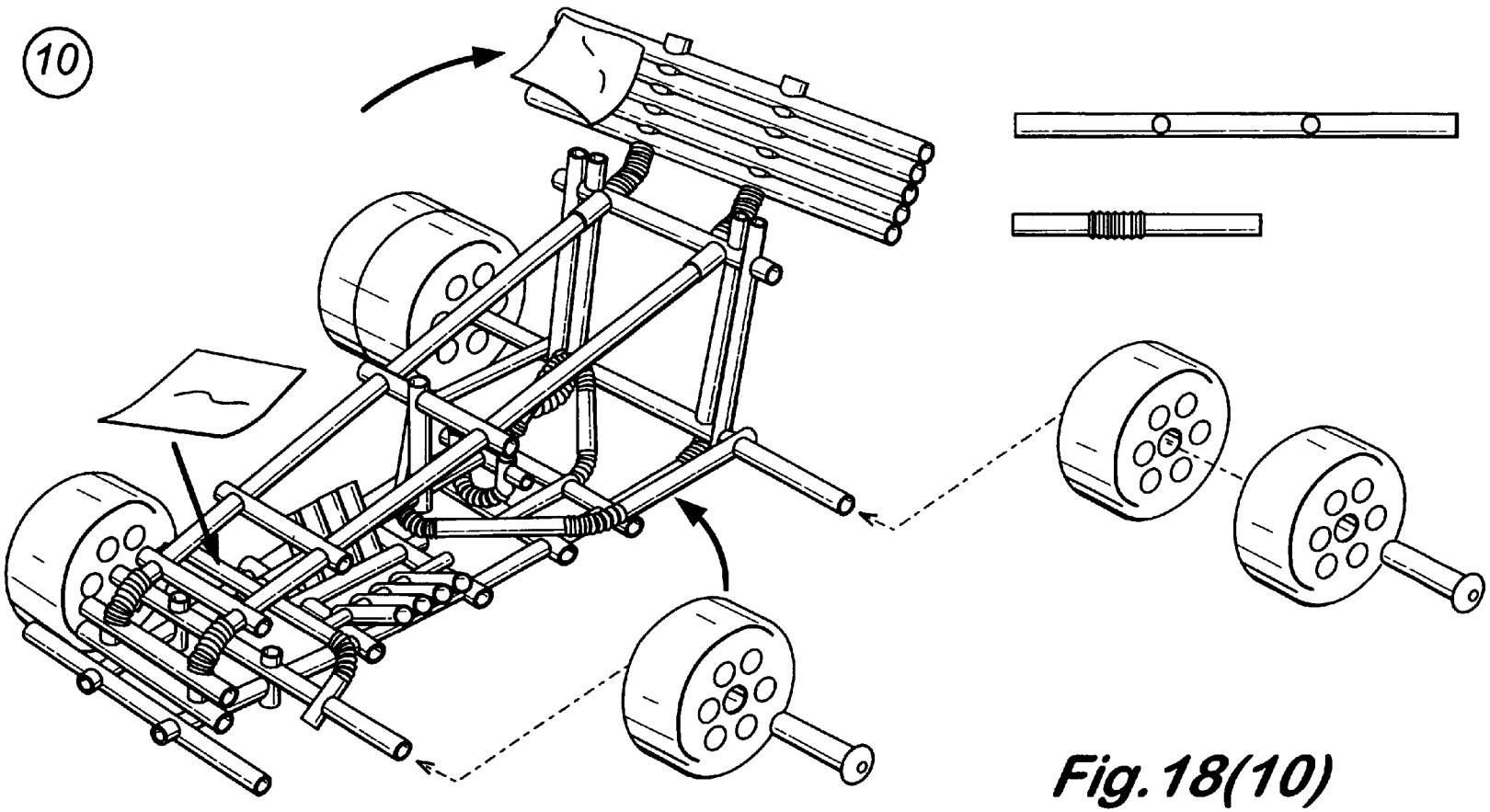

The complexity of the models which can be made depends on the facilities employed, and FIGS. 17(1)–17(6) and 18(1)–18(10) show the range of possibilities. These drawings are intended to be supplied with straws and the tools previously described as modelling kits, and to be understandable by children. They therefore do not need detailed description here. It will be apparent that models of considerable complexity can be produced simply by cutting straws to length and punching pairs of holes in them. In FIGS. 17(1)–17(6) a model swing uses these facilities and also takes advantage of the bendable corrugated regions of two of the straws to shape the seat. In FIGS. 18(1)–18(10) some of the straws are joined end to end by socket joints, and accessories (in this case wheels) are attached to the model using pins of the type previously described.

It will be appreciated that the embodiments described above are nonlimiting, and that modifications may be made to them without departing from the invention.

What is claimed is:

1. A construction kit comprising a multiplicity of straws; further comprising a punch for punching pairs of transversely aligned holes at arbitrary locations through said straws; said straws and said punch permitting a model to be made in which at least some of said straws are joined together with a first straw extending through a second straw via a pair of said transversely aligned holes at an arbitrary location along said second straw, each of said transversely aligned holes being surrounded by portions of said second straw and said first straw fitting tightly within said transversely aligned holes in said second straw.

2. The kit of claim 1 wherein at least some of said straws have bendable corrugated regions.

3. The kit of claim 1, wherein said straws are made of a plastics material.

4. The kit of claim 1, wherein said straws are made of polypropylene.

5. The kit of claim 1, wherein said punch comprises a punch member, a die member, and a support means on either side of said punch member and said die member for supporting flattened surrounding regions of said straws during formation of said transversely aligned holes.

6. The kit of claim 5, further comprising a guide means for locating said straws and guiding said straws longitudinally towards said punch.

7. The kit of claim 6, further comprising a bed, a guide means extending along said bed, a slider movable along said guide means and a means on said slider defining an abutment for longitudinal positioning of said straws relative to said punch.

8. The kit of claim 1, wherein said punch comprises a means engageable in a first pair of holes formed in a straw for maintaining a predetermined angular position of said straw during the formation of at least one subsequent pair of holes.

9. The kit of claim 8, further comprising a support in which said engageable means is angularly rotatable for adjusting the angular position of said straw during the formation of subsequent holes.

10. The kit of claim 7, further comprising a cutter for cutting straws to length.

11. The kit of claim 10, wherein said cutter is provided with a measuring guide.

12. The kit of claim 1, further comprising an expander for insertion into the ends of said straws and for expansion to form straw-receiving sockets.

13. The kit of claim 12, wherein said punch and/or said cutter is provided with a guide track, said expander further comprising a pair of jaws directed parallel to said guide track of said punch and/or said cutter.

14. The kit of claim 12, wherein a single machine provides the functions of punch, cutter and expander, and wherein said machine has an operating handle that is common to all of said three functions.

15. A method for making a model by joining straws together, including the steps of:

providing first and second straws;

punching said first straw at an arbitrary position along said first straw with a punch having substantially the same external diameter as said first straw so that said first straw becomes flattened and a first pair of transversely aligned holes are formed which are separated by undamaged regions of the straw;

allowing said first straw to recover its shape; and passing a second straw through said first pair of transversely aligned holes in said first straw to form a joint in which there is frictional resistance to axial and angular relative movement between said first and second straws.

16. The method of claim 15, further comprising the step of punching said first straw at an arbitrary position with at least a second pair of transversely aligned holes and passing at least a third straw through at least said second pair of transversely aligned holes.

17. The method of claim 16, further comprising the step of passing a member through said first pair of holes after they have been punched so as to maintain said first straw in a predetermined angular position during the punching of said at least second pair of transversely aligned holes.

18. The method of claim 17, wherein said first straw is maintained in an angular position such that said second pair of transversely aligned holes is parallel to said first pair of holes.

19. The method of claim 18, wherein said first straw is maintained at an angular position such that said second pair of transversely aligned holes is at a predetermined angle to said first pair of holes.

20. The method of claim 19, wherein said angle is about 30, 45 or 60 degrees.

21. The method of claim 15, further comprising the step of joining said straws longitudinally together by inserting an end of one of said straws tightly into an enlarged socket end of another of said straws.

22. The method of claim 21, further comprising the step of forming said enlarged socket end by internal pressure applied by an expander tool.

23. The method of claim 15, further comprising the step of fitting at least one decorative or functional element onto at least one of said straws and holding said decorative or functional element in place by pushing a retaining element into an end of said straw.

24. The method of claim 23, wherein said decorative or functional element is a wheel or aircraft propeller.

25. The method of claim 15, wherein a curved portion of said model is defined by at least one straw or portion thereof having a bendable region.

26. The method of claim 25, wherein at least one of said straws or portions thereof is formed with a pair of holes on one side of the bendable region.

27. The method of claim 25, wherein at least one of said straws or portions thereof is formed with a pair of holes on either side of the bendable region.

28. A constructional system for making models out of straws, including a punch for punching pairs of transversely aligned holes through said straws, a cutter for cutting said straws to length, and an expander for expanding ends of said straws into receiving sockets.

* * * * *